US010766048B2

(12) United States Patent
Pettit et al.

(10) Patent No.: US 10,766,048 B2
(45) Date of Patent: Sep. 8, 2020

(54) APPARATUS FOR CLEANING SPRAY GUNS AND BELLS

(71) Applicant: Crystal Cap Cleaners Inc., Burlington (CA)

(72) Inventors: Neil Pettit, Ancaster (CA); Vasudha Kalia, Burlington (CA)

(73) Assignee: Crystal Cap Cleaners Inc., Burlington, Ontario (CA)

( * ) Notice: Subject to any disclaimer, the term of this patent is extended or adjusted under 35 U.S.C. 154(b) by 219 days.

(21) Appl. No.: 16/064,716

(22) PCT Filed: Nov. 22, 2016

(86) PCT No.: PCT/CA2016/051365
§ 371 (c)(1),
(2) Date: Jun. 21, 2018

(87) PCT Pub. No.: WO2018/094498
PCT Pub. Date: May 31, 2018

(65) Prior Publication Data

US 2018/0369852 A1 Dec. 27, 2018

(51) Int. Cl.
*B05B 15/555* (2018.01)
*B05B 14/49* (2018.01)
(Continued)

(52) U.S. Cl.
CPC ..... *B05B 15/555* (2018.02); *B05B 3/06* (2013.01); *B05B 14/412* (2018.02); *B05B 14/49* (2018.02);
(Continued)

(58) Field of Classification Search
CPC ... A47L 15/0065; A47L 15/0089; B08B 3/02; B08B 9/021; B08B 9/023; B08B 9/027;
(Continued)

(56) References Cited

U.S. PATENT DOCUMENTS 3,960,328 A * 6/1976 Archambault ..... A47L 15/23 239/264
4,823,820 A 4/1989 Larson et al.
(Continued)

FOREIGN PATENT DOCUMENTS

CA 2238019 C 5/2004
CN 105 127 037 A 12/2015
(Continued)

OTHER PUBLICATIONS

Supplementary European Search Report; EP Application No. 16 90 4252; dated Nov. 5, 2018; 4 pages.

*Primary Examiner* — David G Cormier
(74) *Attorney, Agent, or Firm* — John H. Thomas, P.C.

(57) ABSTRACT

An improved cleaner for paint spray guns in use on an assembly line comprises a vessel having an inlet, a drain and a port for receiving an atomizer of a spray gun. An impeller is rotatably mounted within the vessel in fluid communication with the inlet. The impeller has an offset cleaning nozzle for projecting a cleaning spray towards the port, a rotational nozzle for projecting a rotational spray to effect rotation of the impeller. The impeller also has an independently controlled central nozzle cleaning nozzle. The cleaner has an air wipe down for removing excess solvent from the atomizer of the spray gun as it leaves the cleaner following a wash cycle. The cleaner comprises a helical flushing means and a solvent purge assembly to clean the inner walls of the vessel. An air and solvent separation fitting provides improved solvent drainage efficiency.

10 Claims, 8 Drawing Sheets

(51) Int. Cl.

| | |
|---|---|
| ***B05B 14/41*** | (2018.01) |
| ***B05B 3/06*** | (2006.01) |
| ***B08B 3/02*** | (2006.01) |
| ***B08B 9/032*** | (2006.01) |
| *B08B 1/00* | (2006.01) |

(52) U.S. Cl.
CPC ..... *B08B 3/022* (2013.01); *B08B 9/0321* (2013.01); *B08B 1/006* (2013.01)

(58) Field of Classification Search
CPC .. B08B 9/032; B08B 9/20; B08B 9/28; B08B 9/283; B08B 9/34; B05B 3/027; B05B 3/06; B05B 15/50; B05B 15/52; B05B 15/55; B05B 15/555; B05B 15/557; B44D 3/006
See application file for complete search history.

(56) References Cited

U.S. PATENT DOCUMENTS

| | | | | |
|---|---|---|---|---|
| 4,977,911 | A * | 12/1990 | Vetter | B05B 15/555 134/34 |
| 5,693,150 | A | 12/1997 | Powell | |
| 2003/0127046 | A1 | 7/2003 | Zehner et al. | |
| 2013/0319470 | A1* | 12/2013 | Kai | B05B 15/555 134/22.12 |

FOREIGN PATENT DOCUMENTS

| | | | |
|---|---|---|---|
| DE | 10 2014 006647 | A1 | 11/2015 |
| GB | 2198033 | A | 6/1988 |

* cited by examiner

APPARATUS FOR CLEANING SPRAY GUNS AND BELLS

CROSS-REFERENCE TO RELATED APPLICATION

This is a National Stage Entry into the United States Patent and Trademark Office from International PCT Patent Application No. PCT/CA2016/051365, having an international filing date of Nov. 22, 2016, the contents of which is incorporated herein by reference in its entirety.

FIELD OF INVENTION

This invention relates to a method and apparatus used in conjunction with robotic paint atomizers, including single gun, double gun and bell atomizers. In particular, the invention relates to an apparatus for cleaning paint spray guns and bells.

BACKGROUND OF THE INVENTION

Paint spray guns and bells are used in a variety of industries to project paint onto an object. The words "spray gun" and "bell" may be used interchangeably in the present patent specification and claims. In the automobile industry, a particular paint spray gun/bell may be used to spray a number of paint coats of different colours onto parts for automobiles. The paint spray gun/bell must be regularly cleaned to remove curing and dry paint on the atomizer end of the spray gun/bell, and prior to the use of paint of a new colour to remove remnants of the first paint. Paint spray guns/bells are cleaned by projecting solvents at high velocity at them while contained within a chamber apparatus. The high velocities are required to remove dried paint from the atomizer end of the gun/bell. The cleaning is effected in a separate vessel to prevent leakage of spent solvent.

Canadian Patent No. 2,238,019 teaches a method and apparatus for cleaning spray guns. The apparatus for cleaning spray guns has a closed vessel having an inlet, a drain and a port for receiving an atomizer of a spray gun. A spray impeller is rotatable mounted within the vessel and in fluid communication with the inlet. The spray impeller has offset cleaning nozzles for projecting a cleaning spray towards the spray gun and a rotational nozzle for projecting a rotational spray to effect rotation of the spray impeller. The port has a seal for sealing while receiving the spray gun and positioning the atomizer of the spray gun in the cleaning spray.

Although the patented apparatus is effective for cleaning spray gun atomizers, it has been noted that a significant amount of spent cleaning solvent remains on the atomizer after it has been cleaned and removed from the closed vessel. The remaining solvent can represent a source of contamination in the paint booth. It would be desirable to have a cleaning apparatus that removes residual cleaning solvent from the atomizer before it is released from the closed vessel of the cleaning apparatus.

In an assembly line situation paint is applied in a cyclical process as many vehicles or components pass down the assembly line. So too, the apparatus for cleaning spray gun atomizers functions in a cyclical process: receiving an atomizer, effecting the cleaning, releasing the atomizer, and recovery and preparing to receive the next atomizer. It would be desirable for the cleaning apparatus to more efficiently capture and drain spent cleaning solvent from the closed vessel so that the duration of the recovery and preparation step could be reduced.

Paint residues which have been cleaned from paint guns can become deposited on the walls of the closed vessel. Over time a build up of paint can form, which if left could hamper the operation of the cleaning apparatus. Periodically the apparatus for cleaning spray guns must, itself, be taken off-line and cleaned. Down time for cleaning the apparatus for cleaning spray guns can disrupt the production cycle of the paint booth and potentially an entire assembly line. It would be advantageous for the apparatus for cleaning spray guns to have a mechanism for preventing retention of residual paint on the walls of the closed vessel.

While the apparatus described in Canadian Patent No. 2,238,019 does clean most surfaces of a spray gun atomizer, it can fail to clean the centre atomizer alley of the atomizer. It would be advantageous to provide an improved apparatus for cleaning spray guns which is capable of cleaning the centre atomizer alley in addition to cleaning other surfaces of the spray gun/bell. A further advantage could be realized if the means for cleaning the centre atomizer alley could function independently of the other cleaning nozzles, to permit the selective targeting of particular surfaces to customize the cleaning to match the particular type and model of spray gun being used on a given assembly line.

SUMMARY OF THE INVENTION

A cleaner for spray guns comprises a vessel having an inlet, a drain and a port for receiving an atomizer of a spray gun. An impeller is rotatably mounted within said the vessel in fluid communication with the inlet. The impeller has an offset cleaning nozzle for projecting a cleaning spray towards said port, a rotational nozzle for projecting a rotational spray to effect rotation of the impeller and an air wipe down for removing excess solvent from the atomizer of the spray gun as it leaves the cleaner following a wash cycle.

The air wipe down comprises a cap attached to the vessel. The cap has a neck extending upwardly therefrom. The neck of the cap and a sleeve which is coaxial with the neck of the cap together define a channel for fluid communication with an air source. The sleeve defining a plurality of air holes therethrough in fluid communication with the channel to direct a flow of air toward the atomizer of the spray gun. The air holes are machined at a downward angle.

The cleaner further comprising a helical flushing means. The helical flushing means comprises a plurality of flushing holes machined through the neck of the cap at an angled offset to direct a lateral flow of air toward the inner wall of the vessel when in fluid connection with an air source.

The cleaner comprises a solvent purge assembly to wash the inner walls of the vessel. The solvent purge assembly comprises an outer ring attached to the inner wall of the vessel and an inner ring mounted within the outer ring and forming a solvent channel therebetween. The outer ring defines a plurality of solvent holes therethrough in fluid connection with the solvent channel. When the solvent purge assembly is in fluid communication with a solvent source, the solvent holes direct the solvent down the inner walls of the vessel.

The cleaner further comprises an air and solvent separation fitting for improved solvent drainage efficiency. The air and solvent separation fitting comprises an outer pipe fitted at the top thereof for sealing fluid connection to the drain of the vessel. The outer pipe defines a plurality of perforations open to the environment positioned adjacent it stop. A tapered inner pipe is mounted coaxially within the outer pipe to extend below the perforations in the outer pipe forming a venting gap between the outer pipe and the inner pipe.

The impeller of the cleaner comprises a domed housing having a first channeled arm and a second channeled arm threaded and welded at opposite ends of the domed housing. Each of the first channeled arm and the second channeled arm define a rotational nozzle. Each of the first channeled arm and the second channeled arm has a cleaning nozzle threadably engaged thereto. A central nozzle is threadably engaged to the top of the domed housing. A fluid conduit is provided for fluid communication between the inlet and the first and second channeled arms.

A hollow stem is independently in fluid communication bewteen the central cleaning nozzle the inlet. The fluid conduit defines an annular fluid path surrounding the hollow stem. The central nozzle is attached to a hollow stem that is attached to a separate fluid path and is independently operated depending upon the need.

DETAILED DESCRIPTION

Figure 1:
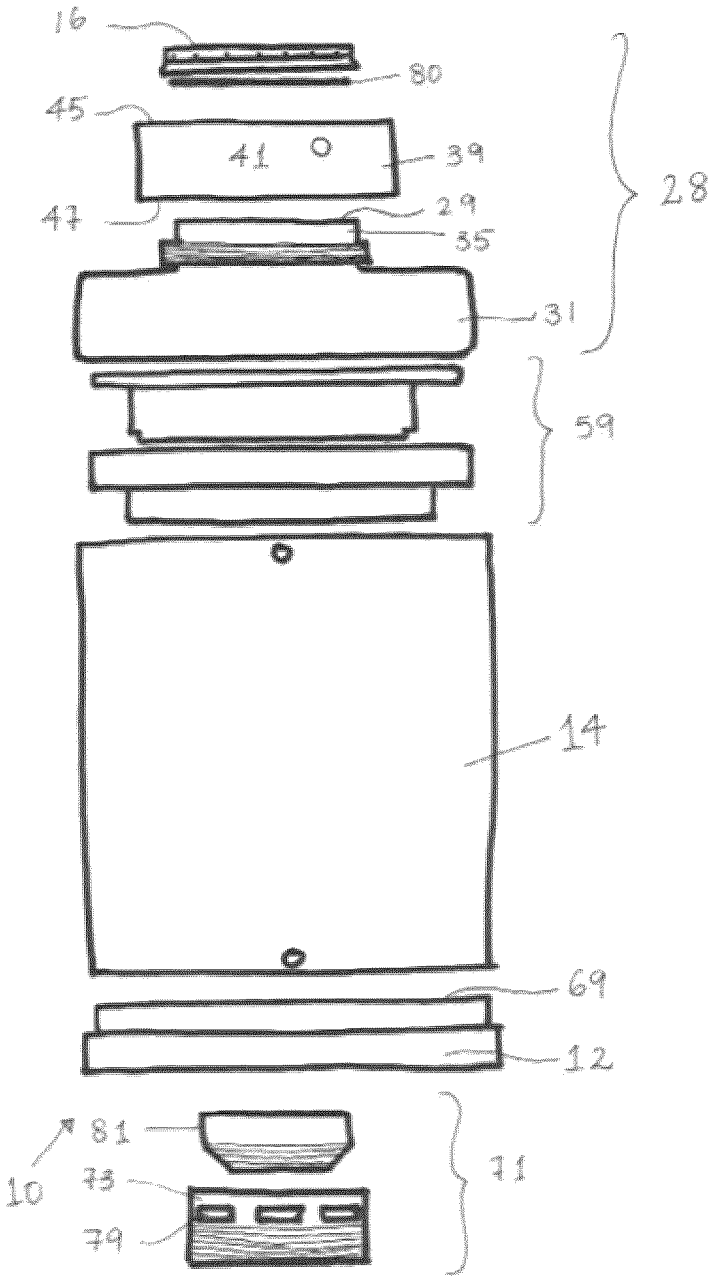
FIG. 1 is a an exploded front elevational view of a first embodiment of a spray gun cleaning apparatus of the present invention.
Figure 2:
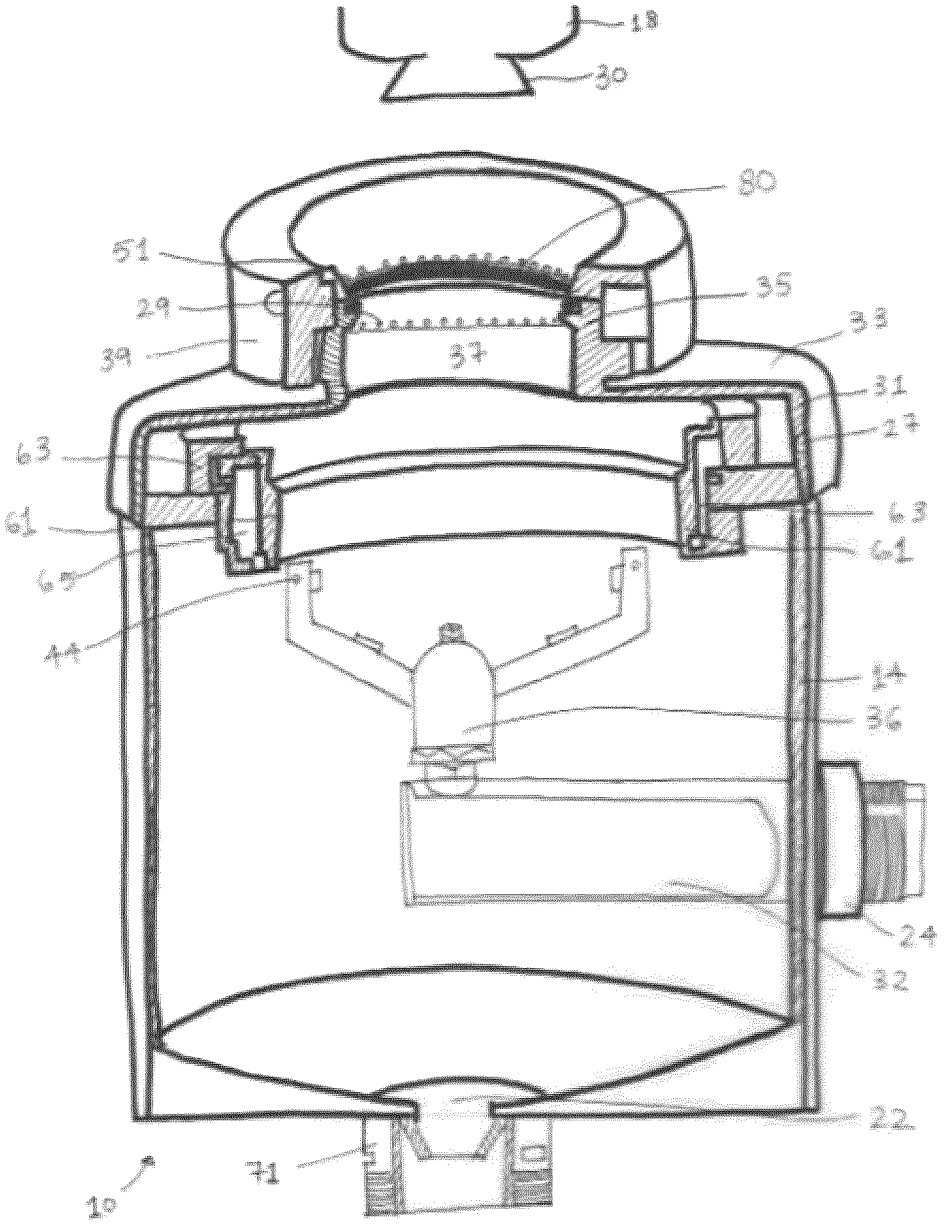
FIG. 2 is a non-exploded partial sectional side view of the cleaning vessel side of FIG. 1.

Referring to FIGS. 1 and 2, a cleaner for cleaning paint from spray guns/bells is illustrated and identified by general reference numeral 10.

The cleaner 10 generally comprises a base 12, a closed vessel 14 having a base 12. At the top of the vessel 14 is a spray gun mount 16 for receiving a spray gun/bell 18. The vessel 14 is a generally hollow vessel having a drain 22 at the bottom thereof, an inlet 24 and a top annular plate having an opening therein. The opening is closed by a cover assembly 28. The cover assembly 28 defines a port identified in FIG. 1 by reference arrow 29 which receives the atomizer 30 of spray gun/bell 18 in a sealing engagement.

The cover assembly 28 comprises a cap 31 which is affixed to the vessel 14. The cap 31 is substantially annular and comprises a base ring 33, from which depends skirt 27 overlapping a portion of the vessel 14. A neck 35 extends upwardly from the base ring 33 of cap 31. The outer diameter of the neck 35 is smaller than the outer diameter of the base ring 33. The inner surface of the neck 35 of cap 31 is identified by reference 37. The neck 35 tapers inwardly near its top end to form the port 29, which receives the atomizer 30. The neck 35 is notched adjacent the port 29 to form a ledge to sealingly receive an O-ring 80.

Figure 3:
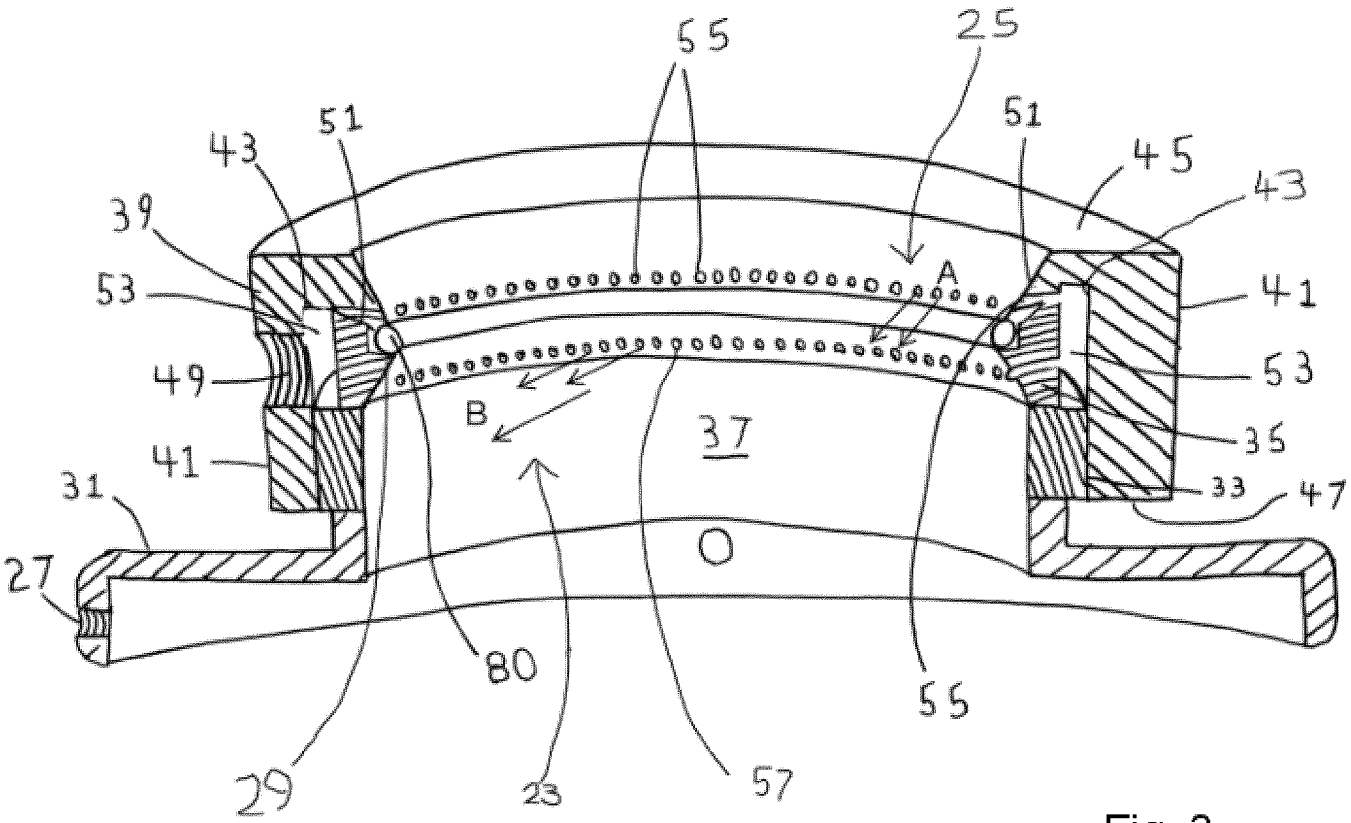
FIG. 3 is an enlarged sectional view of the seal for receiving a spray gun of FIG. 1.

As shown in FIGS. 2 and 3 a substantially cylindrical sleeve 39 rests on the base ring of the cap 31 and is substantially coaxial with the neck 35 of cap 31. The sleeve 39 has, an outer wall 41, a contoured inner wall 43, a top 45 and a bottom 47. A portion of the contoured inner wall 43 is threaded to engage a threaded portion of the base ring 33 of the cap 31. The remainder of the inner wall 43 does not contact the cap 31. Instead, a channel 53 is formed between the neck 35 of cap 31 and the upper portion of the inner wall 43 of the sleeve 39 for fluid communication through air inlet 49 in the sleeve 39 with an air source (not shown). Air inlet 49 permits fluid communication between the channel 53 and an air source.

AIR WIPE DOWN—The cleaner 10 comprises an air wipe down, shown generally by arrow 25 in FIG. 3, for removing excess solvent from the atomizer 30 of the spray gun 18 as it leaves the cleaner following a wash cycle. The sleeve 39 defines an air supply opening 49 for fluid connection between an air source (not shown) and the channel 53. The top 45 of the sleeve 39 is substantially flat adjacent its outer wall 41; but tapers to form an annular overhang 51 over the inner wall 43. The overhang 51 of sleeve 39 defines a plurality of air holes 55 therethrough. The air holes 55 are in fluid communication with the channel 53. As can be seen in FIG. 3, it is preferred for the air holes 55 to be machined at a downward angle in the dihedral plane. When air pressure is activated, air is forced from the channel 53 along the downward path through the air holes 55 in the annular overhang 51 of the sleeve 39. The air exits the air holes 55 in a plurality of air streams directed downwardly and inwardly (as shown by the arrows labelled "A" in FIG. 3) toward the centre of the port 29 to create a tornado type of airflow and provide an air wipe down of the atomizer of the spray gun 18 as it exits the cleaner 10. Residual solvent is blown back into the vessel 14, reducing the amount of solvent which is lost to the environment.

A seal is formed around the spray gun when the atomizer is inserted into through the port 29 for cleaning. An O-ring 80 is seated on the annular overhang 51 to sealingly receive the spray gun. To assemble, the sleeve 39 is press fit into the cap 31, with the O-ring inserted between to prevent leakage of air and solvent.

HELICAL FLUSHING MEANS—The cleaner 10 is further provided with a helical flushing means to cause solvent within the vessel 14 to be pushed downward in a swirling pattern along the walls of the vessel 14. The helical flushing means is identified generally by reference arrow 23 in FIG. 3 This swirling action of the helical flushing means 23 helps to remove paint residue from the walls of the vessel 14 and to push the solvent and paint residue down the drain opening in the bottom of the vessel 14. The helical flushing is accomplished means of an angularly directed flow of air (represented by the arrows labelled "B" in FIG. 3) introduced in to the vessel 14. The flushing means 23 comprises a plurality of flushing holes 57 machined through the neck 35. It is preferred, though not necessary, to use the same air supply as the one used for the air wipe down 25. As illustrated in FIG. 3, the plurality of flushing holes are in fluid connection with the channel 53 which is itself in fluid communication with an air supply (not shown). It is preferred for the flushing holes 57 to be oval in cross section. Moreover, the flushing holes 57 are machined at an angled offset so that as the air emerges from the flushing holes 57 the flow is directed in a lateral direction. As the air flow contacts the inner surface 37 of the neck 35 and then the inner walls of the vessel 14 a helical flow pattern is formed causing the solvent to be pushed in a swirling manner down toward the drain 22 opening in a manner analogous to the flushing action in a toilet bowl.

The cover assembly 28 is preferably constructed from an engineered thermoplastic having characteristics of high stiffness, low friction and excellent dimensional stability. By way of example, the assembly may be constructed from polyoxymethylene which is available under the trademark DELRIN®.

Figure 4:
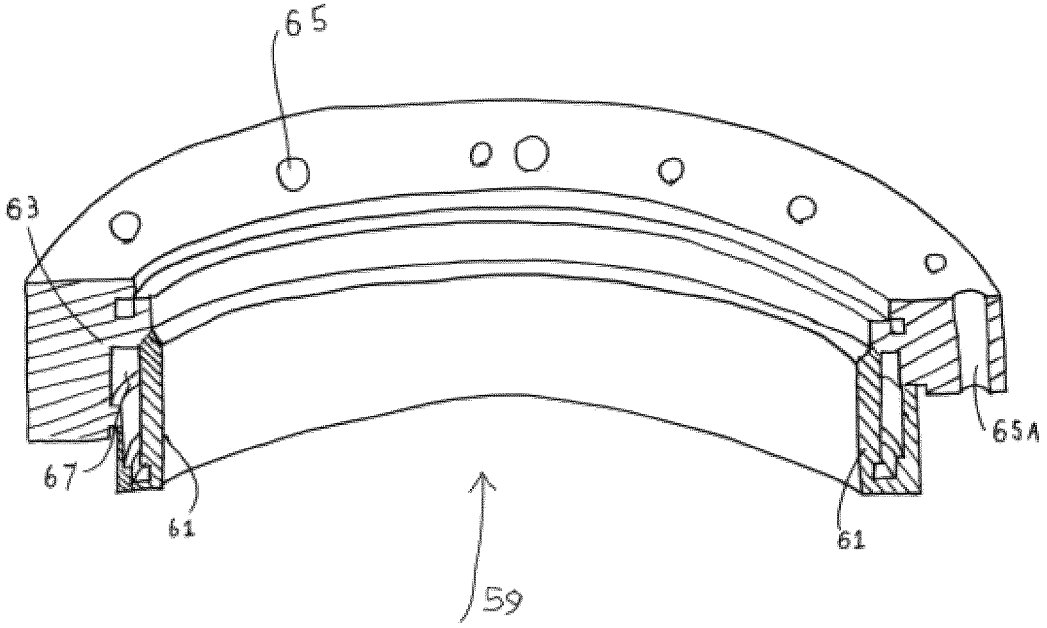
FIG. 4 is an enlarged sectional side view of purge adapter assembly of FIG. 1.

SOLVENT PURGE ASSEMBLY—The cleaner 10 is further equipped with a solvent purge assembly 59 to wash the inner walls of the vessel. As shown in FIGS. 2 and 4, the purge assembly 59 is mounted within the vessel 14. The purge assembly 59 is constructed in two parts: an inner ring 61 and an outer ring 63. The outer ring 63 is the same size as the vessel 14 causing the outer ring 63 to sit on top of the vessel with the inner ring 61 going into the vessel and bolted to the lip of the vessel. The outer ring 63 defines a plurality of solvent holes 65 therethrough. The inner ring 61 fits with the outer ring 63 and is held in place with a flush fit leaving a solvent channel 67 therebetween. The solvent channel 67 is in fluid connection with a solvent source (not shown). When the solvent source is activated solvent is forced through the solvent channel 67 and then flows through the solvent holes 65, which are in fluid communication with the solvent channel 67. FIG. 4 shows a portion of the outer ring 63 cut away and one solvent hole in cross section (identified by reference numeral 65A) to illustrate the fluid communication between the solvent channel 67 and the solvent holes 65. The solvent holes 65 are directed downward and at an angle to the plane, and the solvent holes 65 open into the interior of the vessel 14. The solvent is forced out of the solvent holes 65 at high velocity, whereupon the solvent hits the sides of the interior of the vessel in a swirl like fashion to purge any paint residue stuck to the inner walls of the vessel 14 down into the drain. The base of the vessel is bevelled 69 in order to move solvent and paint residue down to the drain 22.

Figure 5A:
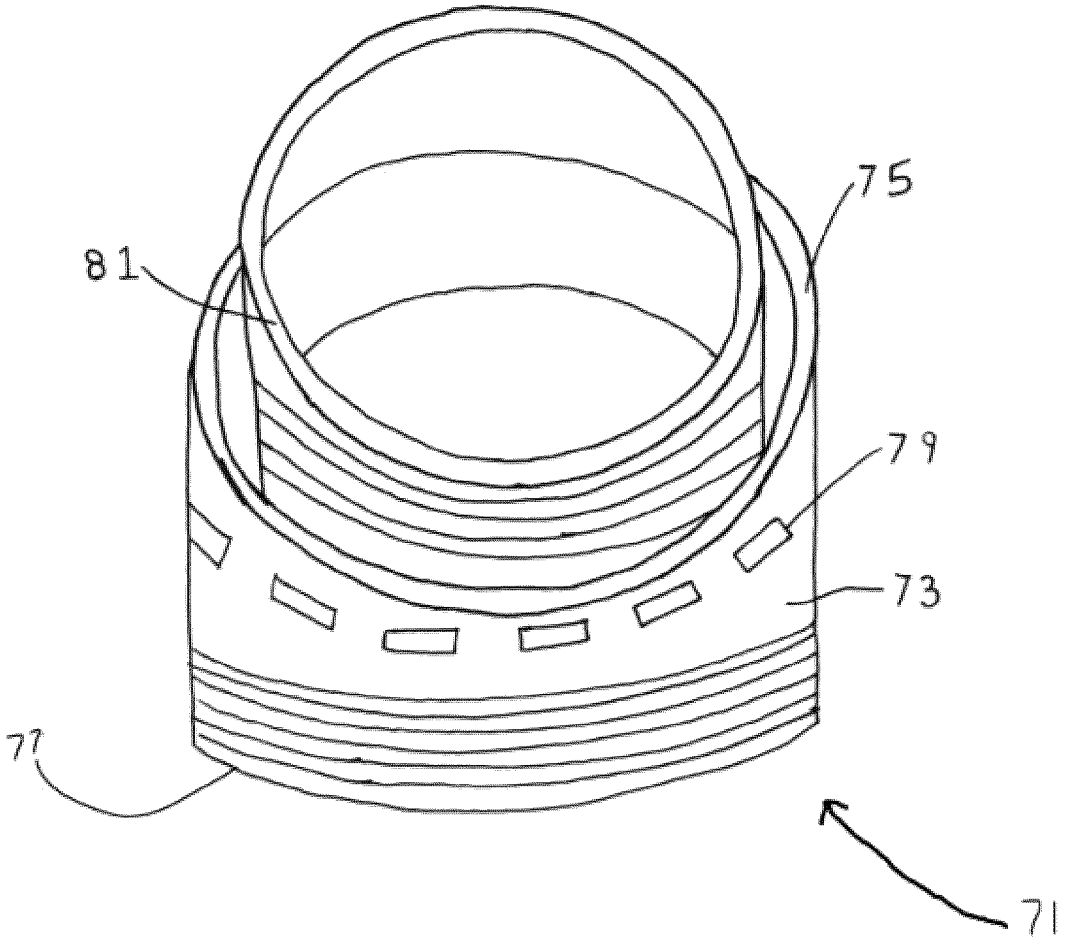
FIG. 5A is a perspective view of the air and solvent separation system of FIG. 1.
Figure 5B:
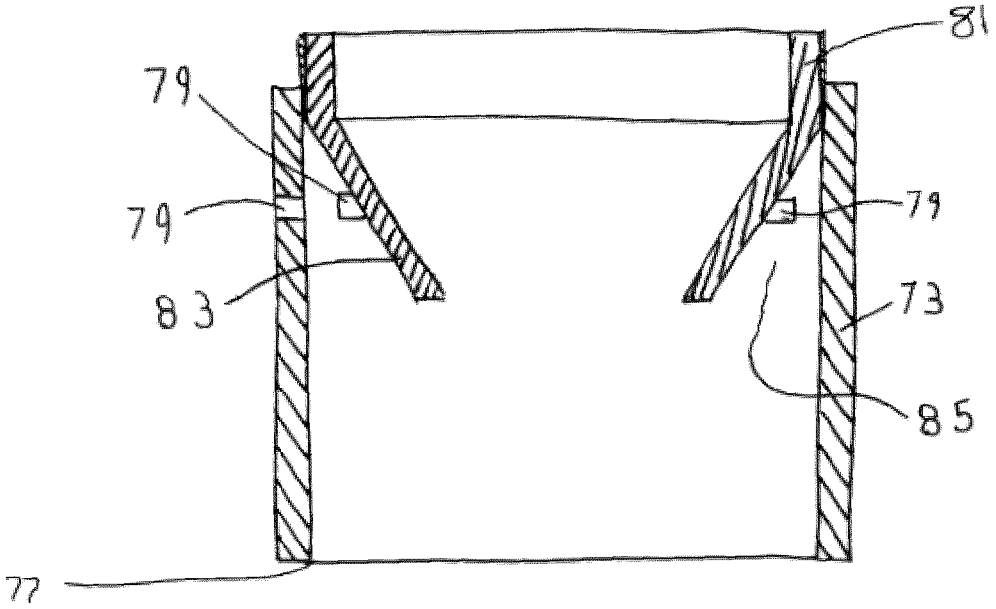
FIG. 5B is a sectional view of the air and solvent separation system.

AIR SOLVENT SEPARATION FITTING—As illustrated in FIGS. 1, 5A and 5B, the cleaner 10 further comprises an air and solvent separation fitting 71 for improved solvent drainage efficiency. The air and solvent separation fitting 71 comprises an outer pipe 73 fitted at the top 75 thereof for sealing fluid connection with the drain 22 of the vessel 14 and fitted at the bottom 77 thereof for sealing fluid communication to a drainage system (not shown). The outer pipe 73 defines a plurality of perforations 79 positioned adjacent the top 75 of the outer pipe 73. A tapered inner pipe 81 is mounted coaxially within the outer pipe 73 and extends below the perforations 79 in the outer pipe 73. The tapered contour 83 of the inner pipe 81 directs the flow of solvent and air toward the bottom of the outer pipe 73. The positioning of the tapered contour 83 of the inner pipe 81 relative to the outer pipe 73 creates a venting gap 85. As mixed air and solvent flow through the fitting, air can dissipate into the venting gap 85. The air can then escape through the perforations 79, and the solvent and paint residue drop to the bottom of the outer pipe and into the drainage system. Removing the air reduces turbulence in the fluid flow of the solvent and paint and speeds the drainage process. The escape of air through the perforations 79 also helps to prevent a pressure build up within the vessel 14 which might otherwise be caused by the influx of air through the air wipe down and the helical flushing mechanism.

Figure 6:
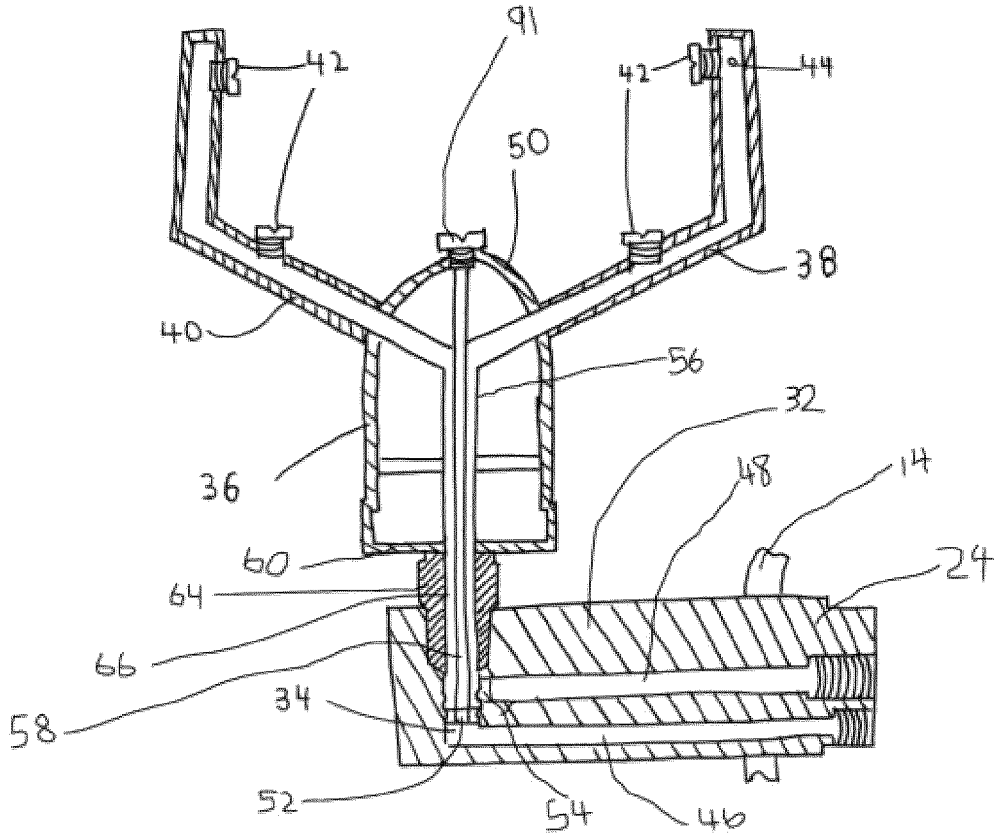
FIG. 6 is a cross sectional view of the duel port impeller of FIG. 1

DUEL IMPELLER—Prior art versions of the cleaner employed a single port impeller inside the vessel of the cleaner to direct streams of solvent toward the atomizer of a spray gun. As shown in FIGS. 2 and 6, the cleaner 10 according to the present invention comprises a duel port impeller 36 which adds a centre cleaning nozzle 91 that can independently direct a spray of solvent to clean the centre galley in the atomizer 30 of a spray gun 18. An inlet fitting 24 is provided to the wall of the vessel 14. The inlet fitting 24 is connected to a pipe or tube 32, which connects to an elbow fitting 34. The elbow fitting 34 has a vertical axis substantially collinear with a central vertical axis of vessel 14. Extending upwardly from the elbow fitting and in fluid communication with the inlet fitting 24 is duel impeller 36. Inlet fitting 24, pipe 32 and elbow fitting 34 all have sufficient structural integrity to firmly support duel impeller 36. Channeled arms 38 and 40 are threadingly engaged to the housing 50 and extend diagonally outwardly from impeller 36 preferably at an angle of 45° towards its axis of rotation. Offset cleaning nozzles 42 are threadingly engaged to each of the arms 38 and 40. The offset cleaning nozzles 42 can be mounted at variable angles to direct solvent streams toward hard to reach places on the atomizer 30 of the spray gun 18 hence customizing our design according to the needs of the buyer. In FIG. 6, one of the nozzles 42 on each arm is directed inwardly toward the centre of the vessel 14 and the other is directed upwardly. The arms 38 and 40 each define rotational nozzles 44 positioned at their distal ends. The rotational nozzles 44 are horizontally directed. When fluid is expelled from the rotational nozzles 44 in horizontal streams projecting tangentially and hitting the inner wall of the vessel to create a centrifugal force which causes the impellers to spin Referring now to FIG. 6, the dual impeller 36 is illustrated in greater detail. Pipe 32 defines a first fluid channel 46 and a second fluid channel 48. The fluid channel 46 connects to a first flow control valve 52 positioned just above the elbow fitting 34. The second fluid channel 48 connects to a second fluid control valve 54. A base fitting 60 has a central aperture having an internal thread therein. Bolt 64 has a central capillary opening 66 through the stem of bolt 64. Bolt 64 is threaded for engaging the threaded aperture of base fitting 60. The capillary opening 66 is connected in fluid communication with the second fluid control valve 54 to the second fluid channel 48. When the bolt 64 is tightened until bushings are compressed fluid communication is allowed between the second fluid channel 48 and a fluid conduit 56 through the impeller. The fluid conduit 56 is branched to provide fluid communication through both of the channeled the arms 38 and 40 to feed the cleaning nozzles 42 and rotational nozzles 44 on each of the arms 38 and 40. The fluid conduit 56 defines an annular fluid path surrounding a central void. Once the cleaning apparatus 10 is assembled and sealed, fluid is able to communicate within the fluid inlet system from the inlet fitting 24, through the second fluid channel 48 in the pipe 32, through second control valve 54, through capillary opening 66 and into fluid conduit 56 and, outwardly in opposite directions through arms 38 and 40, to the rotational nozzles 44 finally upwardly at a 45° angle through cleaning nozzles 42.

A central cleaning nozzle 91 extends distally from the domed housing 50 at the centre point of the dome. The central cleaning nozzle 91 is also in fluid communication with the fluid inlet 24, but it has entirely independent flow path. The first channel 46 in pipe 32 is connected to first fluid control valve 52, which is connected in fluid communication to a hollow stem 58 which passes through coaxially through the capillary opening 66 in the bolt 64. There is no fluid communication between the hollow stem 58 and the capillary opening 66. The stem 58 passes into the impeller and upwardly coaxially through the central void in the conduit 56 and connects in fluid communication to the central cleaning nozzle 91. The operation of the central cleaning nozzle 91 can be controlled completely independently of the cleaning nozzles 42 on the arms 38, 40. The central cleaning nozzle 91 located on top of the domed impeller housing 50 is directed to clean the center galley of the atomizer when needed. Not all atomizers require this feature. This center individually operated nozzle 91 becomes a fluid saving device as, the need for the center galley clean is most often required independent of the total atomizer cleaning function. The central cleaning nozzle 91 being independent of the full cleaning cycle also has the advantage that it can be disabled during the cycle again proving fluid savings.

In order to clean the spray guns and the nozzles thereof, the cleaning fluid or solvent must be complimentary to the paint being used. Solvents such as acetone, methyl ethyl ketone, alcohol and other solvents known in the trade may be used. Since toxic or corrosive solvents are being used, the components of the cleaning apparatus 10 are preferably made of stainless steel and Teflon coated to minimize the residue sticking on the walls of the vessel.

In use, the atomizer 30 of spray gun 18 is presented to port 29. The tapered contour of the annular overhang 51 assists in aligning the atomizer 30 of the spray gun 18 through the port 29 to extend inside the vessel 14. The spray gun 18 is pressed firmly against the O-ring 80 to prevent solvents from escaping therebetween.

Figure 7:
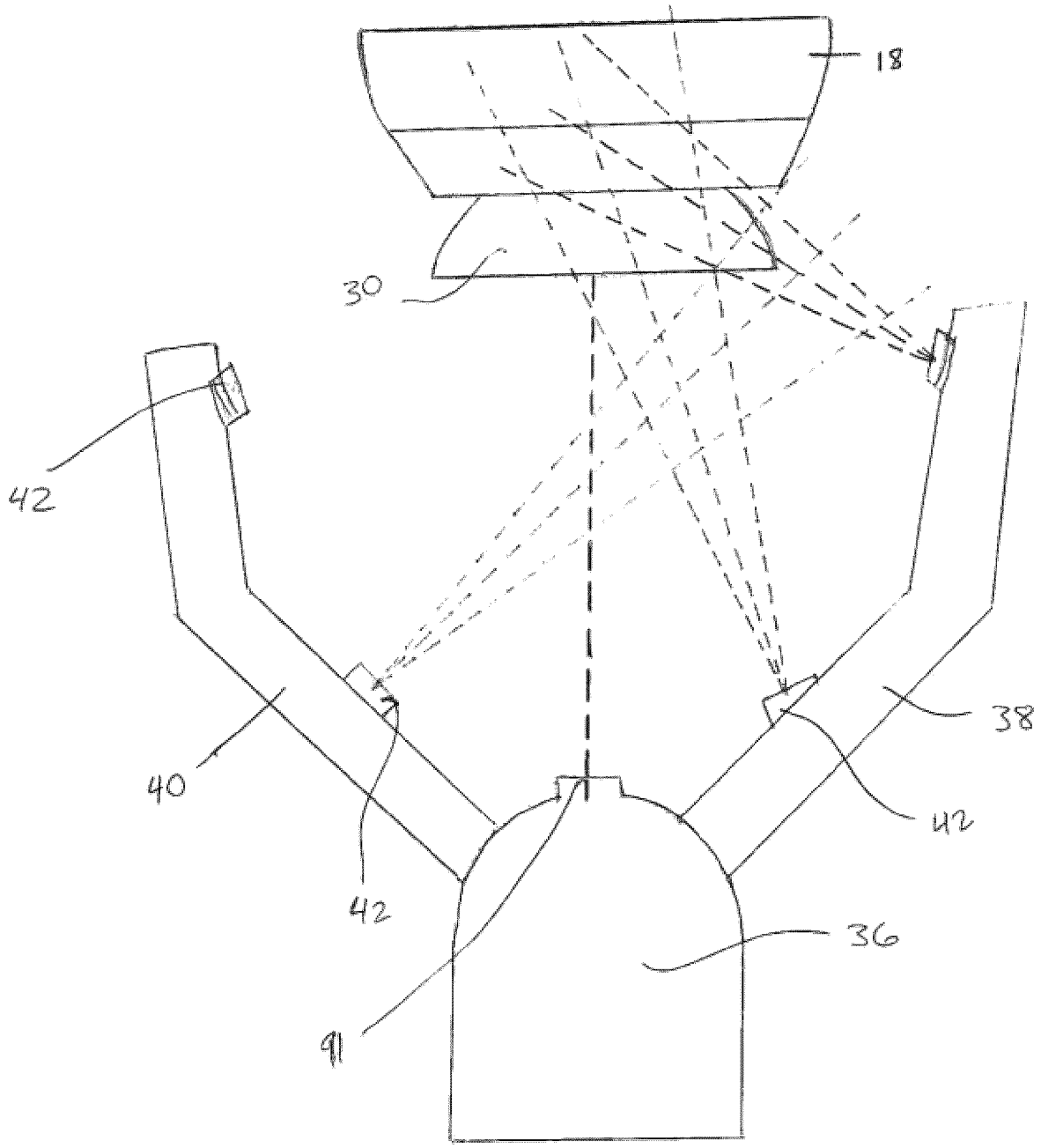
FIG. 7 is a schematic representation of the spray paths of the cleaning nozzles in the vessel of FIG. 1.

Solvent in fluid form and under air pressure is injected into the vessel 14 through inlet 24. Fluid will travel through pipe 32 independently through fluid first and second fluid channels 46 and 48. The fluid travelling through first fluid channel 46 flows under control by valve 52 into stem 58 to feed central cleaning nozzle 91. The fluid travelling through the second fluid channel 48 flows under control by valve 54 and into the capillary opening 66 in bolt 64, and then up into impeller 36, passing up through fluid conduit 56, and outwardly through arms 38 and 40. The fluid will escape through rotational nozzles 44, which will cause a tangential spray in opposite directions, urging the impeller 36 to rotate about its axis of rotation. The spray from rotational nozzles 44 will also project cleaning fluid onto the inside walls of vessel 14. The fluid will also travel up to cleaning nozzles 42 to project a cleaning spray of fluid at atomizer 30 of spray gun 18. As is apparent, since impeller 36 is rotating and the cleaning nozzles 42 are offset from the axis of rotation of the impeller, the cleaning spray from cleaning nozzles 42 will also rotate and will apply fluid circumferentially about the atomizer 30 at different angles to target various hard to reach areas of the atomiser. FIG. 7 schematically shows in dashed lines the expected tangential spray paths from one of the cleaning nozzles 42 on arm 40 and both cleaning nozzles 42 on arm 38. The spray path from central nozzle 91 is also shown as a dashed line and travels as a stream from the central nozzle 91 directly upward to the centre galley of the atomizer 30 of the spray gun 18.

The interior of the vessel 14 and all parts of the cleaner 10 that are exposed to and may come in direct contact with any purged paint, any contamination or any outside paint booth materials may be coated in a polytetrafluoroethylene based material, such as the coating marketed under the trademark TEFLON™. The use of a non-stick coating on the all of the exposed components will provide smoother, slippery surfaces over which solvent and paint residues may travel more quickly down the walls of the vessel toward the drain. Paint residues carried along more quickly have less time to dry in place or build up on the inner walls of the vessel 14, the arms and cleaning nozzles of the impeller etc., making the overall cleaning process more efficient.

The cleaner 10 can be custom configured to provide variable cleaning actions including custom configurations for the vessel cleaning through the purge ring when necessary. Each project requires different solutions and the cleaner is capable of providing custom solutions. The duel impeller system can be custom configured to attack all and any areas of the contaminated atomizer either in one complete operation or in separate and individual programmed sequences that allows for time and fluid savings. The positioning of the cleaning nozzles and the length and angle of the impeller arms can all be custom configured to the exact requirements for cleaning any particular one of the atomizers and guns that are available. The impellers are custom configured for each atomizer. If a user changes the atomizer on its paint line in future, a new impeller having the desired specifications can be retrofit into the cleaner 10.

The Impeller of claim is propelled by air which is fed through the outside mounted check valve assembly channelled to the base of the impeller via a solid bar with dual feeding galleys. The impeller body is domed and twin arms which also are channeled direct the atomized mixture from the base to the nozzles on each arm. The nozzles can be custom directed at the exact areas on the atomizer where the contamination is present. These can be angled through 45 degrees. The nozzles can also be adjusted through 180 degrees to vary the amount of time that the spray is directed vertical and/or horizontal. The variable adjustments that are custom configured for each independent model of atomizer insure maximum effect and minimum fluid usage.

We claim:

1. A cleaner for spray guns comprising a vessel having an inlet, a drain and a port for receiving an atomizer of the spray gun; an impeller rotatably mounted within said vessel in fluid communication with said inlet, the impeller having an offset cleaning nozzle for projecting a cleaning spray towards said port, a rotational nozzle for projecting a rotational spray to effect rotation of said impeller; and, an air wipe down for removing excess solvent from the atomizer of the spray gun as it leaves the cleaner following a wash cycle; said air wipe down comprising:

(a) a cap attached to the vessel and having a neck extending upwardly therefrom;

(b) a sleeve, coaxial with the neck of the cap, and together with the neck of the cap defining a channel for fluid communication with an air source; and, (c) said sleeve defining a plurality of air holes therethrough in fluid communication with the channel to direct a flow of air toward the atomizer; and (d) a helical flushing means.

2. The cleaner of claim 1, wherein said helical flushing means comprises a plurality of flushing holes machined through the neck of the cap at an angled offset to direct a lateral flow of air toward an inner wall of the vessel when in fluid connection with the air source.

3. The cleaner of claim 2, wherein the flushing holes are oval in cross section.

4. The cleaner of claim 2, further comprising a solvent purge assembly to wash the inner walls of the vessel.

5. The cleaner of claim 4 wherein the solvent purge assembly comprises:

(a) an outer ring attached to the inner wall of the vessel;

(b) an inner ring mounted within the outer ring and forming a solvent channel therebetween; and, (c) the outer ring defining a plurality of solvent holes therethrough in fluid communication with the solvent channel to direct solvent down the inner wall of the vessel when in fluid communication with a solvent source.

6. The cleaner of claim 1 further comprising an air and solvent separation fitting for improved solvent drainage efficiency.

7. The cleaner of claim 6, wherein the air and solvent separation fitting comprises:

(a) an outer pipe fitted at the top thereof for sealing fluid connection to the drain of the vessel, the outer pipe defining a plurality of perforations open to the environment positioned adjacent the top thereof;

(b) a tapered inner pipe mounted coaxially within the outer pipe to extend below the perforations in the outer pipe forming a venting gap between the outer pipe and the inner pipe.

8. The cleaner of claim 1, wherein the impeller comprises:

(a) a domed housing having a first channeled arm and a second channeled arm threaded and welded at opposite ends of the domed housing;

(b) each of said first channeled arm and said second channeled arm defining a rotational nozzle and having a cleaning nozzle threadably engaged thereto;

(c) a central cleaning nozzle threadably engaged to a top of the domed housing;

(d) a fluid conduit for fluid communication between the inlet and the first channeled arm and the second channeled arm; and, (e) a hollow stem independently in fluid communication between the central cleaning nozzle and the inlet.

9. The cleaner of claim 8, wherein the fluid conduit defines an annular fluid path surrounding the hollow stem.

10. The cleaner of claim 1, wherein the vessel, the drain, the impeller and all surfaces that would be in contact with purged or virgin paint are coated with a polytetrafluoroethylene material.

* * * * *